United States Patent [19]

Boehme

[11] Patent Number: 4,504,830

[45] Date of Patent: Mar. 12, 1985

[54] DISPLAY APPARATUS FOR FACILITATING MAINTENANCE OF COMPUTER EQUIPMENT

[75] Inventor: Robert M. Boehme, Worcester, Mass.

[73] Assignee: Honeywell Information Systems Inc., Waltham, Mass.

[21] Appl. No.: 349,428

[22] Filed: Feb. 16, 1982

[51] Int. Cl.[3] ..... G08B 5/36

[52] U.S. Cl. ..... 340/815.31; 340/635; 40/547

[58] Field of Search ..... 340/815.31, 635; 350/96.1, 96.L1, 96.28; 40/547; 455/613, 618, 600; 358/901

[56] References Cited

U.S. PATENT DOCUMENTS 3,829,857 8/1974 Allan et al. ..... 340/815.31
3,918,053 11/1975 Towne et al. ..... 340/815.31
4,310,974 1/1982 Gdovin et al. ..... 40/547

*Primary Examiner*—Gerald L. Brigance
*Attorney, Agent, or Firm*—Faith F. Driscoll; Nicholas Prasinos

[57] ABSTRACT

The apparatus displays information in a manner which permits viewing at convenient operator locations. It connects to a selected number of points within the computer printed circuit boards of the equipment. The apparatus includes light emitting diode circuits and associated transparent rods for conveying the light indicator information signals to convenient locations for operator viewing. The exposed ends of transparent rod elements are conically shaped so as to concentrate the light indicator signals in sharply defined cones of light so as to be viewed from any angle by an operator located at a considerable distance from the computer equipment.

27 Claims, 4 Drawing Figures

DISPLAY APPARATUS FOR FACILITATING MAINTENANCE OF COMPUTER EQUIPMENT

BACKGROUND OF THE INVENTION

1. Field of Use

This invention relates to display apparatus and more particularly to apparatus which facilitates the maintenance of computer equipment.

2. Prior Art

In general, conventional computer equipment includes sets of printed circuit boards which plug into a number of mounted connectors. To facilitate fault detection or equipment failures, indicator circuits are connected to various points within the printed circuit boards for displaying on a visible panel to operator personnel.

It has been found that in order for operator personnel to be able to view such indications, they have to be seated close to the computer equipment. Additionally, more circuits are required to be added to the computer equipment to connect the indicator circuits to visual light circuits associated with such display panels. Even when this is done, operator personnel must be close to the panel to view such indications because the normal light intensity is usually not strong enough to be viewed at any distance. Furthermore, unless the indications can be viewed at normal eye level in a direct line, an operator may still not be able to detect such indications.

The above disadvantages are magnified when several points within a printed circuit board are required to be displayed. In many instances, the printed circuit boards are positioned near ground level and the points to be displayed are so obstructed that indicator light circuits cannot be directly connected to such points for operator viewing. Accordingly, it becomes quite costly in terms of circuit board space, connectors and circuits to provide for the display of such points.

Accordingly, it is a primary object of the present invention to provide apparatus for facilitating maintenance and use of computer equipment.

It is a further object of the present invention to provide display apparatus for use with computer equipment which displays indications important to diagnosis of failures and errors with a minimum of complexity and cost.

SUMMARY OF THE INVENTION

The above objects and advantages are achieved in a first embodiment of the present invention in which the apparatus of the invention connects to the selected points within the computer printed circuit boards at which the information signals to be displayed are located. The apparatus includes light emitting diode circuits and associated transparent rods for conveying the information signals to convenient locations for operator viewing.

In accordance with the invention, each light emitting diode circuit is snuggly seated within a cavity located at one end of its associated transparent rod. In the preferred embodiment, a rod of plexiglas material is utilized. The remaining clearance or space between the rod and a plastic container having the light emitting diode circuit is filled or occupied by a transparent fluid or adhesive agent. When subjected to curing, the fluid is transformed into a glass-like substance. This eliminates two changes in refractive indices thereby eliminating any attendant light losses in the optical path provided by the rod.

More importantly, in accordance with the teachings of the present invention, the viewing end of each transparent rod is conically shaped having an included angle which approximates 90 degrees. This concentrates the light in a sharply defined cone at the apex of the tip of the rod. When so concentrated, the distinctive bright cone of light can be viewed by operator personnel at any angle. That is, it can be viewed from the front, sides or even from behind. The length of each transparent rod can be extended or shortened as desired to overcome any obstructions (e.g. components, wiring, fixtures, etc.) located on or adjacent to the printed circuit board. Also, each rod is securely fastened by a metal holder which fits over the rod and clips onto the board.

In a second embodiment of the present invention, the apparatus of the present invention is utilized in conjunction with one panel of an enclosure containing computer diskette equipment. In this embodiment, the light emitting diode circuit is external to the transparent rod and is mounted within the enclosure. The diode circuit is positioned at one end of the transparent rod in direct line with its axis. The length of the transparent rod is to pass through the enclosure panel and to extend a predetermined distance beyond the panel surface so as to be conveniently viewed. The internal portion of the rod is reduced in diameter so that it can be easily attached to the panel by means of a shaft retainer element. In accordance with the present invention, the viewing end of the rod is conically shaped so as to be visible from various off axis viewing locations.

The above embodiments of the present invention provide apparatus which enables operator personnel to view fault and error indications at convenient locations thereby facilitating maintenance of computer equipment. This is achieved with a minimum of additional circuits and at cost.

The novel features which are believed to be characteristic of the invention both as to its organization and method of operation, together with further objects and advantages will be better understood from the following description when considered in connection with the accompanying drawings. It is to be expressly understood, however, that each of the drawings is given for the purpose of illustration and description only and is not intended as a definition of the limits of the present invention.

DESCRIPTION OF THE PREFERRED EMBODIMENTS OF THE PRESENT INVENTION

Figure 2A:
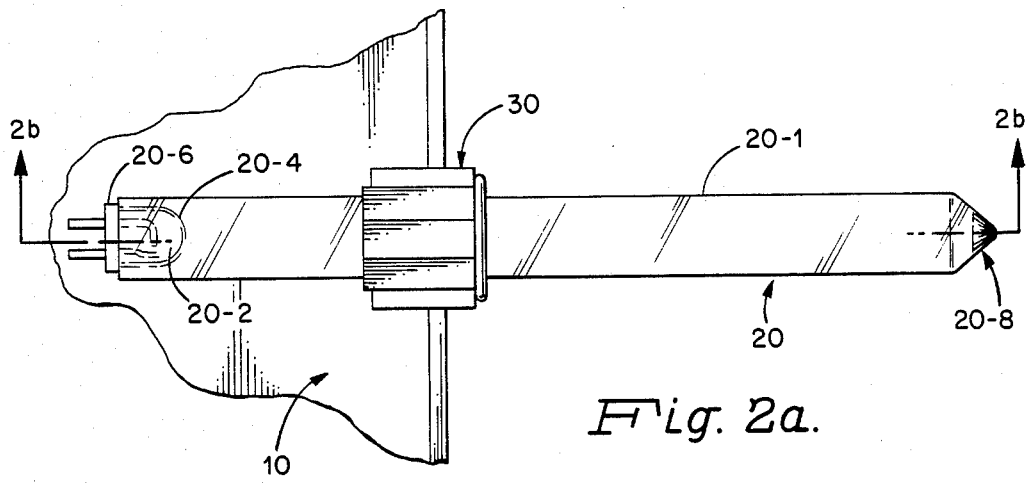
FIG. 2*a* illustrates a top view of the indicator apparatus of the present invention shown in FIG. 1 including a preferred holder fastener.
Figure 2B:
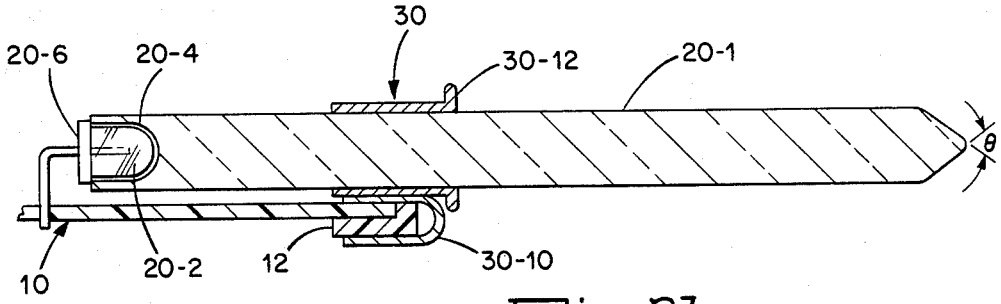
FIG. 2*b* illustrates a cross-sectional side view of the indicator apparatus of the present invention shown in FIG. 2*a*.

FIG. 2 shows a computer printed circuit board 10 which includes the apparatus of the present invention. As seen from the Figure, the circuit board 10 includes a substantial number of dual in-line packages (DIPS) containing integrated circuits used to construct a computer. The DIPS are arranged in rows and columns as shown. Each DIP is inserted into rows of holes at the appropriate location. Thereafter, the pins of all of the DIPs are dip soldered to the conductor pattern located on the bottom of printed circuit board 10.

It will be appreciated that there are a number of key signal points within the computer which are required to be monitored to ensure normal operation. As seen from FIG. 1, there are four such signal points. To achieve such monitoring, the apparatus 20 of the present invention is connected to each such point as shown. The connections are made by inserting the anode and cathode leads of the light emitting diode (LED) circuit portion of apparatus 20 into a pair of holes which connect to the desired points within the conductor pattern on the bottom of the printed circuit board. Again, connection is made when the board is dip soldered or by normal soldering for a printed circuit board whose construction has already been completed.

Each point normally connects to one output of a bistable device such as a flip-flop whose change in state corresponds to the presence or absence of a voltage representative of a binary ONE. In the present embodiment, the voltage corresponding to a binary ONE has a value approximating +3 volts while a binary ZERO has a value which approximates 0 volts. The anode and cathode leads of each such LED portion are approximately connected to each such flip-flop so as to switch state of the flip-flop associated therewith.

Figure 1:
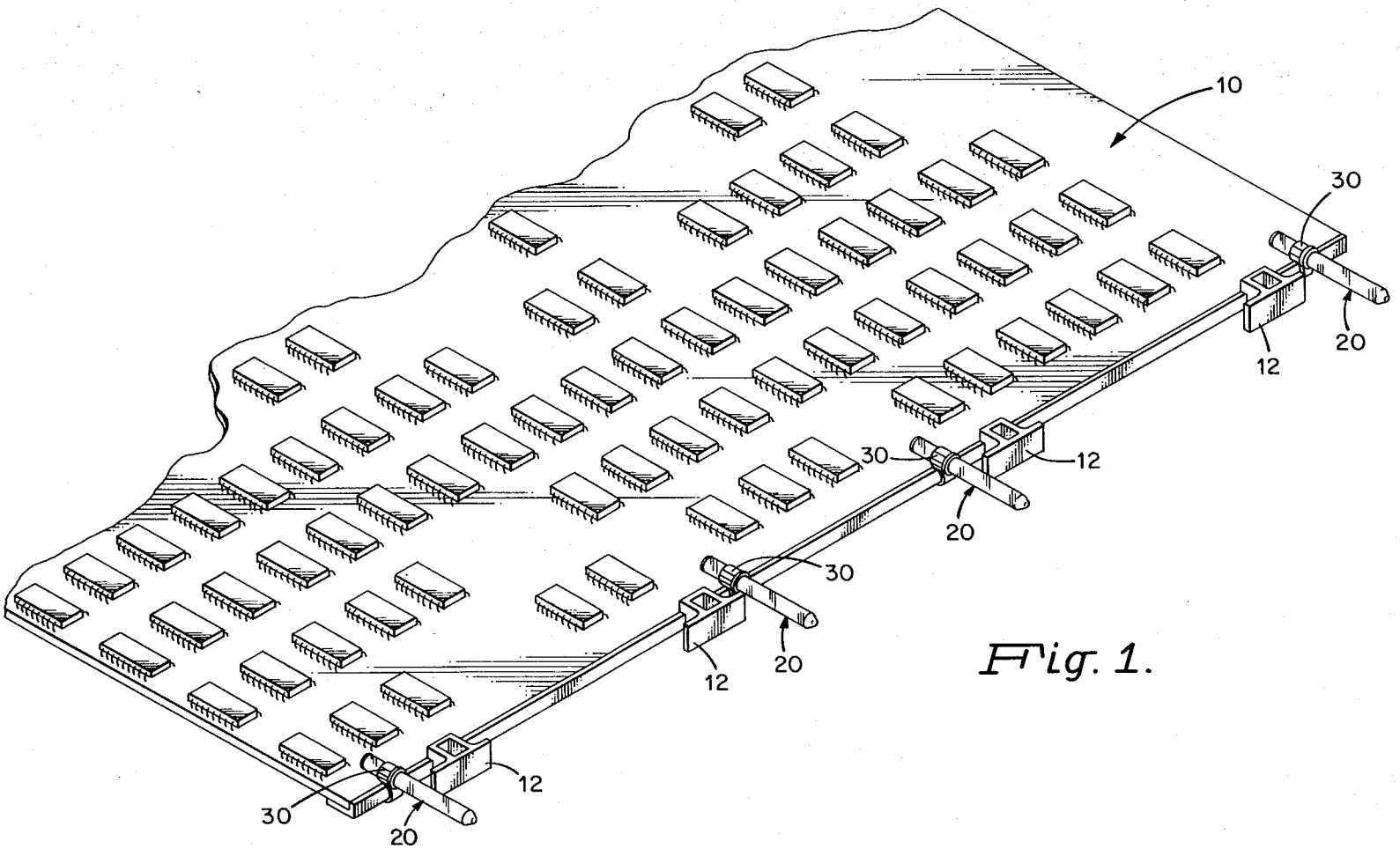
FIG. 1 illustrates a perspective view of a portion of a computer printed circuit board which incorporates a first embodiment of the indicator apparatus of the present invention.

As seen from FIG. 1, the transparent rod portion of apparatus 20 extends beyond board obstructions such as card pulling elements 12 positioned along the outside edge of the board 10. The opposite edge of board 10 plugs into suitable mounting connectors in a conventional manner.

The apparatus 20 of the present invention is shown in greater detail in FIGS. *2a* and *2b*. Referring first to FIG. *2a*, it is seen that apparatus 20 includes a plexiglass transparent rod element 20-1 which approximates $\frac{1}{4}$ inches in diameter. The end of the rod element 20-1 which connects to the printed circuit board has a cavity containing the LED circuit 20-2. The LED circuit 20-2 is housed in a translucent plastic container shaped as shown in FIGS. *2a* and *2b*. The diameter of the LED container approximates 0.185 inches ±0.015 inches while the cavity has a diameter which approximates 0.200 inches. The length of the LED circuit 20-2 approximates 0.301 inches while the length of the cavity approximates 0.32 inches. Accordingly, the LED circuit 20-2 snuggly seats in the cavity at one end of rod element 20-1.

The remaining space 20-4 between the LED circuit 20-2 container and cavity is full occupied by a transparent fluid or adhesive agent. Such an adhesive may take the form of the adhesive described in the publication titled Loctite Technical Data Sheet High Impact U.V. Curing Adhesive 352, Copyright 1978 by Loctite Corporation.

The adhesive agent is inserted into the cavity of rod element 20-1. The rod element 20-1 is slid over LED circuit 20-2 so that it almost completely covers the LED container leaving only a base portion 20-6 exposed as shown in FIGS. *2a* and *2b*. The adhesive agent is then exposed to ultraviolet light and is transformed into a glass like substance. Such curing or exposure is carried out in a conventional manner. For example, the RC-250 system, manufactured by Xenon Corporation, can be used to cure the adhesive agent inserted into space 20-4 of apparatus 20.

When the above curing takes place, the light or optical path includes only one material. That is, two changes in refractive indices with accompanying light losses have been eliminated from the optical path. Since the candle power of LED circuit 20-2 only approximates 0.8 millicandela, it is essential that such light losses be avoided.

Each of the rod elements 20-1 is positioned as shown in FIG. 1 and fastened to board 20 by mounting element 30 as explained herein. As seen from FIGS. *2a* and *2b*, the viewing end of transparent rod element 20-1 is conically shaped and polished. The cone tip angle $\theta$ can vary between 60 degrees to 120 degrees. However, it has been found that an internal angle of approximately 90 degrees concentrates the light emitted from LED circuit 20-2 into a sharply defined cone at the apex of the cone tip. The cone 20-8 is represented by the shaded portion in FIG. *2a*. To ensure maximum safety, the tip of the cone portion has been slightly rounded.

Accordingly, when an LED circuit 20-1 is switched on, the current passing therethrough generates light which is transmitted through its transparent rod element 20-1. This produces the sharply defined cone of light at the tip of the cone which corresponds to the shaded portion of the cone shown in FIG. *2a*. This distinct bright cone of light can be seen at considerable distance and is quite visible notwithstanding the height and the angle of viewing. Thus, an operator is not constrained to be positioned in a certain manner in order to determine whether or not an error or fault condition has occurred within the computer.

FIGS. *2a* and *2b* also illustrate in greater detail, the mounting arrangement for securely fastening the transparent rod elements 20-1 to printed circuit board 10. While it will be appreciated that a number of different types of fasteners can be employed, the holder element 30 has been found to provide secure positioning notwithstanding vibration, etc. The element 30 includes a clip portion 30-10 and a collar portion 30-12. In greater detail, the clip portion 30-10 is constructed by modifying a "U" clip fastener type number C2855-017 manufactured by Eaton-Tinnerman Corporation. The modification involves spreading the pair of outer legs to accommodate the $\frac{1}{8}$ inch thickness of printed circuit board 10 and eliminating the center leg portion of the clip. The resulting modified clip portion 30-10 is as shown in FIG. *2b*.

The collar portion 30-12 is constructed by modifying a Hex RIVNUT fastener type S25H85 manufactured by B. F. Goodrich Corporation. The modifications involve removing threads within the nut fastener. The resulting modified fastener portion 30-12 is as shown in FIG. *2b*. As seen from FIG. *2b*, the holder element 30 is formed by joining together clip portion 30-10 and collar portion 30-12 as shown. The transparent rod element 20-1 is passed through the collar portion 30-12 of holder element 30 which is securely fastened to board 10 by means of its clip portion.

Figure 3:
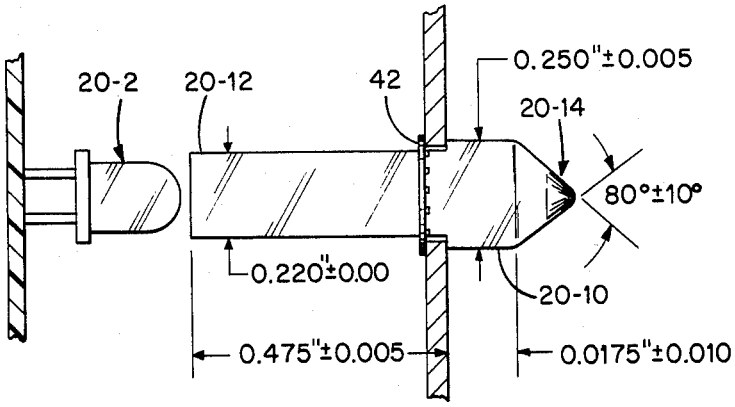
FIG. 3 illustrates a panel arrangement which incorporates a second embodiment of the apparatus of the present invention.

FIG. 3 illustrates a second embodiment of the present invention which is intended for use with other types of computer equipment as, for example, computer diskette equipment. In this equipment, an LED circuit connects to the power supply circuits of the diskette equipment. It is used as a d-c power ON indicator. Accordingly, it is desired that the state of the LED circuit be viewable at the rear panel of the cabinet or enclosure which houses the diskette equipment.

FIG. 3 illustrates an arrangement which includes apparatus constructed in accordance with the principles of the present invention. In this embodiment, the LED circuit element 20-2 internal to the enclosure is located outside the transparent rod element 20-1. It is positioned to the right of element 20-1 in direct line with its axis as shown.

From FIG. 3, it is seen that the length of rod element 20-1 is selected to pass completely through a viewing hole of the rear panel 40 of the cabinet and beyond a predetermined distance for operator viewing at any angle. That is, rod element 20-1 includes two portions. A first portion 20-10 which has a diameter of 0.250 inches is exposed to operator view. A second portion 20-12 is located internal to panel 40 has a slighter smaller diameter of 0.220 inches so as to permit proper mounting. A preferred mounting arrangement employs the shaft retainer element 42 of FIG. 3 which fits over section 20-12 as shown.

In accordance with the teachings of the present invention, the viewing end of transparent rod element 20-1 is conically shaped as shown. Again, this concentrates the light transmitted by LED circuit 20-2 into a distinct cone 20-14 which appears as indicated by the shaded portion of the cone tip. The LED circuit 20-2 can be considered equivalent to the LED circuit shown in FIGS. *2a* and *2b*.

The above embodiments illustrate how the apparatus of the present invention facilitates the signalling of faults and errors within computer equipment. With a minimum of cost and additional hardware elements, such apparatus may be incorporated into existing computer equipment or included in newly constructed equipment whose convenient operator viewing is desired. With such apparatus, operator personnel need no longer be positioned close to such equipment in order to detect the occurrence of faults and error conditions. The apparatus of the present invention makes such conditions readily and easily viewable.

It will be obvious to those skilled in the art that many changes may be made to the preferred embodiments of the present invention. For example, different types of light emitting diode circuits may be employed. Also, different types of mounting or holders may be employed. Other changes in materials, dimensions, etc. will also occur to those skilled in the art.

While in accordance with the provisions and statutes there has been illustrated and described the best form of the invention known, certain changes may be made to the system described without departing from the spirit of the invention as set forth in the appended claims and, in some cases, certain features of the invention may be used to advantage without a corresponding use of other features.

What is claimed is:

1. Indicator apparatus for use with computer equipment including at least one signal point internal to said equipment which is to be monitored and displayed at a corresponding indicator position internal to said equipment, said indicator apparatus comprising:

light emitting diode means coupled to said one signal point for converting low level signals appearing at said signal point into unconcentrated low intensity light signals;

transparent rod means, one of said ends of said rod means being coupled to said light emitting diode means and the other end of said rod means having a predetermined conical shape for concentrating said low intensity light signals applied to said one end by said light emitting diode means and transmitted axially by said rod means into a sharply defined cone; and, means for mounting said transparent rod means at a predetermined point within said computer equipment at said indicator position so that a portion of said transparent rod means including said other end is completely unobstructed by said equipment for viewing said sharply defined cone at long distances notwithstanding the viewing angle for determining the state of said low level signals appearing at the signal point.

2. The indicator apparatus of claim 1 wherein said one end of said transparent rod means includes a cavity of a first diameter and said light emitting diode means having one end connected to said signal point and the other end having a seond diameter smaller than said first diameter for snuggly positioning said end within said cavity and said first and second diameters forming a space including a transparent fluid cured to form a substance similar to said rod means so as to effectively eliminate light losses.

3. The apparatus of claim 1 wherein said computer equipment includes a printed circuit board and said means for mounting includes a collar portion and a clip portion, said collar portion having an internal diameter larger than said first diameter so as to slip over said transparent rod means at said predetermined point and said clip portion being attached to said printed circuit board.

4. The apparatus of claim 2 wherein said other end of said light emitting diode means, said substance and said transparent rod means are constructed from like materials.

5. The apparatus of claim 4 wherein said materials are plastic.

6. The apparatus of claim 1 wherein said one end of said transparent rod means is conically shaped and polished to form a cone having a predetermined included angle.

7. The apparatus of claim 6 wherein said predetermined included angle approximates 80 degrees $\pm 10$ degrees.

8. The apparatus of claim 6 wherein said transparent rod means is constructed from Plexiglas material.

9. Indicator apparatus for use in a computer printed circuit board including a number of internal signal points which are to be monitored, said indicator apparatus comprising:

a number of transparent rod elements corresponding in number to said number of signal points, one end of each said plurality of rods being conically shaped for concentrating light applied to the other end into a sharply defined cone and the other end including a cavity of a first predetermined diameter;

a number of light emitting diode circuits, one end of each diode circuit being connected to one of said number of signal points, the other end of each of said diode circuits being housed within a plastic container having a second predetermined diameter smaller than said first predetermined diameter for snuggly positioning each light emitting diode circuit within said cavity of a different one of said plurality of rods; and, means for mounting each of said plurality of transparent rod elements securely to said circuit board at a desired point enabling said sharply defined cones of light generated by said plurality of light emitting diode circuits to be viewed at long distances and at any angle.

10. The apparatus of claim 9 wherein said first predetermined and second predetermined diameters form a space, said space being completely filled with transparent fluid which has been cured so as to form a glass like substance thereby providing a path for transmitting light having a single refractive index eliminating light losses.

11. The apparatus of claim 9 wherein said one end of each of said plurality of transparent rod elements is conically shaped and polished to form a cone having a predetermined included angle.

12. The apparatus of claim 11 wherein said predetermined included angle is between 60 and 120 degrees.

13. The apparatus of claim 11 wherein said predetermined included angle approximates 80 degrees ±10 degrees.

14. The apparatus of claim 11 wherein said predetermined included angle approximates 90 degrees.

15. The apparatus of claim 11 wherein each of said plurality of transparent rod elements is constructed from Plexiglas material.

16. The apparatus of claim 11 wherein each of said plurality of transparent rod elements is of a predetermined length for transmitting light from said diode circuits to points which are free from obstructions connected and adjacent to said printed circuit board.

17. The apparatus of claim 9 wherein each of said means for mounting includes a collar portion and a clip portion, said collar portion having a predetermined diameter so as to slip over one of said transparent rod elements and said clip portion being attached to said printed circuit board.

18. The apparatus of claim 17 wherein said collar and clip sections are metal.

19. Indicator apparatus for use with an exposed panel of an enclosure containing electronic equipment, said panel including at least one indicator position, said indicator apparatus comprising:

at least one transparent rod element having a predetermined length, one end of said transparent rod element having a predetermined conical shape for concentrating unconcentrated low intensity light signals applied to the other end into a sharply defined cone, said transparent rod element including first and second portions having first and second diameters respectively, said transparent rod being positioned at said one indicator position so that said first portion including said conically shaped one end is exposed for viewing on said panel and said second portion passing through and being located internal to said panel, said second diameter of said second portion being smaller than said first diameter for attaching said rod to said panel; and, a light emitting diode circuit connected to said electronic equipment for providing a low level signal to be displayed at said indicator position, said light emitting diode circuit being positioned adjacent to the other end of said transparent rod element so as to be aligned with the axis of said rod element so as to enable said unconcentrated low intensity light signals generated by said light emitting diode circuit in response to said signal and transmitted axially along said rod to be concentrated into said sharply defined cone by said one end which corresponds to said signal being displayed at said indicator position to be viewable at long distances from said panel.

20. The apparatus of claim 19 wherein said first portion is of a length which permits convenient operator viewing.

21. The apparatus of claim 19 wherein said second portion is of a length which approximates the distance between said panel and said light emitting diode circuit for maximum transmission of light produced by said light emitting diode circuit.

22. The indicator apparatus of claim 19 wherein said conically shaped end of said first portion is shaped and polished to form a cone having a predetermined included angle.

23. The apparatus of claim 22 wherein said predetermined included angle is between 60 and 120 degrees.

24. The apparatus of claim 22 wherein said predetermined included angle approximates 80 degrees ±10 degrees.

25. The apparatus of claim 22 wherein said predetermined included angle approximates 90 degrees.

26. The apparatus of claim 19 wherein each of said plurality of transparent rod elements is constructed from Plexiglas material.

27. The apparatus of claim 19 wherein said apparatus further includes a retainer means having a diameter larger than said second diameter so as to slip over said rod element for attachment to said panel.

* * * * *